US011054208B2

(12) United States Patent
Johansen et al.

(10) Patent No.: US 11,054,208 B2
(45) Date of Patent: Jul. 6, 2021

(54) APPARATUS FOR FASTENING A DEVICE ONTO A BARREL OF A FIREARM

(71) Applicant: A-TEC HOLDING AS, Son (NO)

(72) Inventors: Anders Eckhoff Johansen, Son (NO); Hallvard Winterseth, Saltnes (NO)

(73) Assignee: A-Tec Holding AS, Son (NO)

( * ) Notice: Subject to any disclaimer, the term of this patent is extended or adjusted under 35 U.S.C. 154(b) by 0 days.

(21) Appl. No.: 15/877,439

(22) Filed: Jan. 23, 2018

(65) Prior Publication Data

US 2019/0226788 A1 Jul. 25, 2019

(51) Int. Cl.
*F41A 21/32* (2006.01)
*F41A 21/34* (2006.01)

(52) U.S. Cl.
CPC ..... *F41A 21/325* (2013.01); *F41A 21/34* (2013.01)

(58) Field of Classification Search
CPC ..... F41A 21/325; F41A 21/34
See application file for complete search history.

(56) References Cited

U.S. PATENT DOCUMENTS 3,775,792 A * 12/1973 Leonard ..... B23G 7/02 470/204
3,842,877 A * 10/1974 Andrews ..... F16B 37/085 411/259
4,233,737 A * 11/1980 Poehlmann ..... B26B 1/042 30/161
4,781,507 A * 11/1988 Duenas ..... B25B 5/10 269/185
4,920,679 A * 5/1990 Sarles ..... F41A 21/481 42/75.02
5,559,302 A * 9/1996 Latka ..... F41A 21/325 89/14.05
6,052,935 A * 4/2000 Howard ..... F41A 21/40 42/75.02
7,353,740 B1 * 4/2008 Hoffman ..... F41A 21/26 42/107
7,610,710 B2 * 11/2009 Brittingham ..... F41A 21/325 181/223
8,261,478 B2 * 9/2012 Laney ..... F41A 3/30 42/51

(Continued)

OTHER PUBLICATIONS

White, Mark, "A Brief History of the Maxim 1909 .22 Caliber Silencer", http://www.smallarmsreview.com/display.article.cfm?idarticles=235 (Year: 2011).*

(Continued)

*Primary Examiner* — Joshua T Semick
(74) *Attorney, Agent, or Firm* — Christian D. Abel

(57) ABSTRACT

The present invention relates to a coupling member for quick and easy attachment and detachment of a firearm accessory to a muzzle of the firearm, the coupling member comprising a female member and a male member, wherein the female member is provided with a throughgoing bore, the female member further being provided with a number of successive threaded portions and unthreaded portions around a circumference of the throughgoing bore and wherein the male member around an outer circumference is provided with the same number of successive threaded portions and unthreaded portions as the female member.

11 Claims, 5 Drawing Sheets

(56) References Cited

U.S. PATENT DOCUMENTS

| | | | | |
|---|---|---|---|---|
| 8,381,629 | B2 * | 2/2013 | Szecsei | F41A 3/24 42/16 |
| 8,382,415 | B1 * | 2/2013 | Goldbaum | F16B 39/122 411/366.1 |
| 8,714,301 | B2 * | 5/2014 | Shults | F41A 21/30 181/223 |
| 8,978,286 | B2 * | 3/2015 | Schafer | F41A 21/40 42/79 |
| 9,328,985 | B2 * | 5/2016 | Malcolm | F41A 21/488 |
| 9,337,263 | B2 | 6/2016 | Ferdinand | |
| 9,383,154 | B2 * | 7/2016 | Stone | F41A 21/481 |
| 9,513,078 | B1 * | 12/2016 | Fulton | F41A 21/30 |
| 9,903,678 | B2 * | 2/2018 | Sherrill | F41A 21/36 |
| 9,921,021 | B1 * | 3/2018 | Graham, II | F41A 21/325 |
| 2008/0156183 | A1 | 7/2008 | Brittingham | |
| 2010/0139145 | A1 | 6/2010 | Brittingham | |
| 2013/0133976 | A1 | 5/2013 | Johansen | |
| 2014/0237881 | A1 * | 8/2014 | Mack | F41A 21/325 42/90 |
| 2016/0202013 | A1 | 7/2016 | Lessard | |
| 2017/0139158 | A1 * | 5/2017 | Coenegracht | G02B 6/3825 |
| 2017/0167816 | A1 | 6/2017 | Young | |
| 2017/0184367 | A1 | 6/2017 | Odle | |
| 2017/0241733 | A1 | 8/2017 | Salvador | |
| 2017/0321985 | A1 * | 11/2017 | Bray | F41A 21/34 |
| 2018/0017352 | A1 | 1/2018 | Addis | |

OTHER PUBLICATIONS

Yondering, "Gate Guide for making thread cutting tool", http://www.300blktalk.com/forum/viewtopic.php?t=90129&start=10, pp. 1-12 (Year: 2014).*

* cited by examiner

APPARATUS FOR FASTENING A DEVICE ONTO A BARREL OF A FIREARM

FIELD OF THE INVENTION

The present invention relates generally to firearms, accessories and accessory mounts for firearms, and particularly to muzzle end accessories and accessory mounts for firearms.

BACKGROUND OF THE INVENTION

The term "firearms" includes hand guns (including revolvers and pistols), long guns (including rifle and shotguns), automatic weapons (including machine guns, submachine guns and automatic rifles), and air-operated firearms.

It is often desirable to mount an accessory such as a flash suppressor or muzzle brake, silencer, grenade launcher, blank adapter, or the like, upon the muzzle or end of gun barrels. Such accessories are usually mounted upon an adapter which constitutes a coupling for attaching the accessory to the gun barrel.

Muzzle end mounted firearm accessories are available for attachment to the barrel of firearms to obtain various effects when the firearm is operated. Silencers are an example of such an accessory and include baffled chambers to slow the release of pressure from the barrel of the firearm. The slowed release of pressure reduces the audible report during firing. Flash hiders are another type of muzzle end accessory that include features to mix unburnt gunpowder and air in a manner that reduces the overall brightness of a flash that may occur during firing. Generally speaking, silencers and flash hiders may be mounted to the muzzle end of a firearm barrel in different rotational orientations without affecting the operation of the accessory.

Some muzzle end mounted accessories are designed for mounting to a firearm barrel in one or more particular rotational orientations to accomplish a desired effect. Muzzle brakes redirect a portion of combustion gases sideways or rearward, with respect to the firing direction, as the gases escape from a barrel when a shot is fired. As the gases are redirected, the firearm is pushed forward in a manner that counteracts recoil of the firearm. Muzzle brakes are typically mounted to a firearm barrel in a particular rotational orientation, so as to prevent gases from being redirected upward into the line of sight of the firearm operator. The manner of rotationally orienting a muzzle end accessory on the barrel is often referred to as timing the accessory to the barrel.

Compensators are another type of muzzle end accessory that is timed to one or more particular rotational orientations when mounted to a firearm barrel. Compensators redirect the flow of gasses that escape from a barrel during firing in an overall upward direction. The resulting force that acts against the firearm counteracts other forces that urge the muzzle end of a rifle upward during firing.

It is known how to utilize firearm accessory adapters which include an opening receiving the end of the gun barrel and lugs, wherein the adapter includes lug retaining recesses which align with and retain the lugs upon relative rotation of the adapter and the gun barrel occurring after the adapter has been fully axially positioned upon the gun barrel.

U.S. Pat. No. 4,893,426 A relates to a lugged coupling apparatus, where an internally threaded collar having internal lugs is slidably received on a shaft comprising corresponding external lugs and is threadedly engaged on a threaded member and when rotated will engage the lugs and draw the shaft and threaded member together to form a secure, accurately aligned mechanical coupling which may be disassembled by reversing the process. The collar need never to be completely removed from the threaded member to install or remove the shaft.

U.S. Pat. No. 5,433,133 A relates to a quick detachable gun barrel coupling member, where the front end of the coupling member has an internally threaded portion having a left-hand thread. The rear end of the coupling member has a plurality of circumferentially spaced notches that form finger members between them. The finger members have radially inwardly extending lug members. The coupling member is slidably received on the front end of the gun barrel of a firearm and has at least three radially extending lug members and when rotated the respective lug members will engage each other. When a firearm accessory is threaded into the front end of the coupling member, it will form a secure, accurately aligned mechanical coupling which may be disassembled by reversing the process.

The use of a threaded lock member to maintain the lugs within the adapter lug retaining recesses requires several steps of operation to mount the adapter on the gun barrel. It cannot easily be accomplished with one hand, and the possibility of the adapter loosening on the barrel exists in the event the threaded lug locking member unloosens due to vibration occurring during firearm operation.

BRIEF SUMMARY OF THE INVENTION

It is an object of the invention to provide a coupling for a firearm accessory which may quickly be mounted upon a muzzle of a firearm wherein only axial and rotative one hand movement is required to mount and lock the adapter on the muzzle of the firearm.

This object is achieved according to the invention by means of the features indicated in the following independent claim, where further features of the invention will become apparent from the dependent claims and the description below.

The present invention relates to a coupling member for quick and easy attachment and detachment of a firearm accessory to a muzzle of the firearm, where the firearm accessory, for instance, may be a flash suppressor or muzzle brake, a silencer, a grenade launcher, blank adapter, or the like.

The coupling member according to the present invention comprises a female member and a male member, where the female member is provided with a throughgoing bore and a number of successive threaded portions and unthreaded portions around a circumference of the throughgoing bore, and where the male member is provided with the same number of successive threaded portions and unthreaded portions as the female member around its outer circumference.

Each of the female and male members must be provided with the same numbers of threaded and unthreaded portions, and where the number of threaded portions (and thereby also the number of unthreaded portions) may be two or more. In one embodiment, each of the female and male members may be provided with three threaded portions and three unthreaded portions, where the threaded portions may be arranged 60 degrees displaced relative each other.

If the female member and the male member are provided with two threaded portions, the threaded portions may be arranged 90 degrees displaced relative each other. If the female member and the male member are provided with four threaded portions, the threaded portions may be arranged 45 degrees displaced relative each other.

In one exemplary embodiment, the coupling member according to the present invention may be used to attach a silencer directly to the muzzle of the firearm, or indirectly via a flash suppressor or muzzle brake. If the silencer is attached directly to the muzzle of the firearm, then the muzzle of the firearm is formed to be and to function as the male member, while the silencer is formed to be and to function as the female member. Alternatively, an adapter may be connected to the silencer, the adapter then being formed to be and to function as the female member, whereby the adapter is provided with a threaded portion around its outer circumference in order to be connected to the silencer through a corresponding internal threaded portion provided in the silencer.

If the silencer is attached indirectly to the muzzle of the firearm through the flash suppressor, then the silencer is formed to be and to function as the female member, while the flash suppressor is formed to be and to function as the male member. The flash suppressor is then provided with a threaded portion around an inner circumference of a throughgoing bore in order to be connected to the muzzle of the firearm.

In another exemplary embodiment, the coupling member according to the present invention may be used to attach a flash suppressor to the muzzle of the firearm, whereby the muzzle of the firearm is formed to be and to function as the male member, while the flash suppressor is formed to be and to function as the female member.

As flash suppressors and silencers may be designed and formed in many ways known to a person skilled in the art, these are not described any further herein, but a person skilled in the art would know how these should be formed to obtain their function as a flash suppressor or silencer.

When the female member and the male member of the coupling member according to the present invention are to be attached to each other, the male member is inserted into the female member in such a way that the unthreaded portions of the male member are aligned with the threaded portions of the female member, whereafter the male member is rotated anticlockwise in order to bring the threaded portions of the male member into contact with the threaded portions of the female member, thereby locking the female member and the male member of the coupling member. When the female member and the male member of the coupling member are to be detached, the male member is rotated clockwise, such that the threaded portions of the male member are brought out of contact with the threaded portions of the female member. When the male member is rotated a certain distance, the unthreaded portions of the male member are aligned with the threaded portions of the female member, whereby the male member can be removed from the female member.

The female member of the coupling member may be provided with at least one abutment shoulder around the circumference of the throughgoing bore, where the at least one abutment shoulder will cooperate with at least one abutment shoulder provided around an outer circumference of the male member. The abutment shoulders will then restrict the distance the male member can be moved along a longitudinal direction of the female member and further provide a correct adjustment or setting of the threaded portions of the female and male members, such that male member can be rotated without further adjustment. The abutment shoulders of the female and male members will also form a tight connection in the coupling device when the female and male members are locked together.

The at least one abutment shoulder of the female member may be arranged to be perpendicular to an axis extending in a longitudinal direction of the female member, or the at least one abutment shoulder may be arranged to form an angle relative said axis extending in a longitudinal direction of the female member. If, for instance, each of the female and male members is provided with two abutment shoulders, one abutment shoulder may be arranged at the beginning and at the end of the threaded portions, both abutment shoulders may be arranged to be perpendicular to the axis, both abutment shoulders may be arranged to form the same or different angles relative the axis, or one abutment shoulder may be arranged to be perpendicular to the axis while the other abutment shoulder may be arranged to form an angle relative the axis.

In one embodiment, the female member of the coupling member may be provided with a groove extending around the outer periphery of the female member, where the groove furthermore is provided with two throughgoing holes and at least one throughgoing recess. The groove is adapted to accommodate a spring element. The spring element is provided with two bent end terminations and at least one bead. The spring element will be held in the groove by arranging the bent end terminations of the spring element into the throughgoing holes, and the bead will then be arranged in the throughgoing recess. The bead will have a form and a size that will allow the bead to protrude into the throughgoing bore of the female member. The throughgoing recess will be arranged in such a way that it covers a part of the threaded portion and a part of the adjacent unthreaded portion. As the bead protrudes into the throughgoing bore, a certain force must be applied to the male member when the male member is rotated relative the female member in order to lock the female and male members together, and the bead will also prevent the male member from unlocking unintentionally from the female member.

In one embodiment, the female member may be provided with an external threaded portion, for instance when the female member is an adapter that is intended to be connected to a silencer, where the silencer is provided with an internal threaded portion on an inside of the throughgoing bore.

The female member may have a circular cross-section, but it could be envisaged that the female member could have other cross-sections, such as polygonal cross-section, an oval cross-section or the like.

In one embodiment, the male member may be provided with a throughgoing bore.

In one embodiment, the male member may be provided with an internal threaded portion.

The male member may, over at least a part of its longitudinal length, be provided with a substantially triangular form, where the acute angles of the triangle is rounded.

Further objects, structural embodiments and advantages of the present invention will be clearly shown in the following detailed description, the attached drawings and the following claims.

BRIEF DESCRIPTION OF THE DRAWINGS

The invention will now be explained with reference to the attached figures in which.

DETAILED DESCRIPTION OF THE INVENTION

Figure 1:
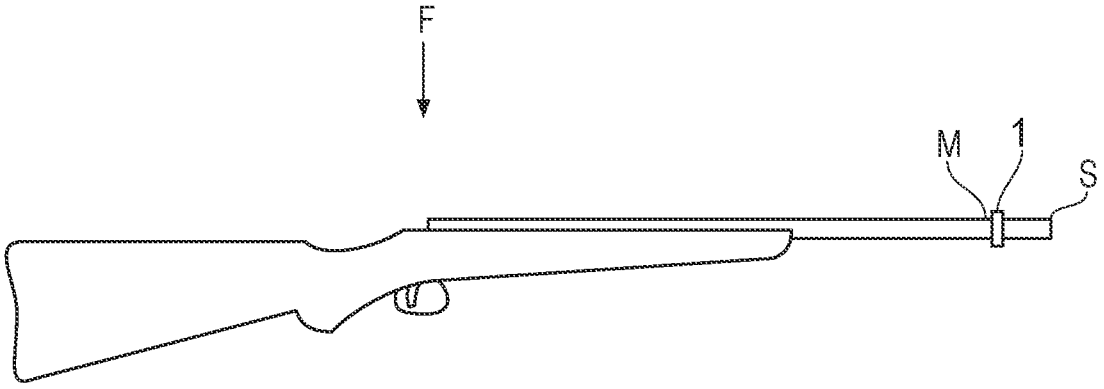
FIG. 1 illustrates in a schematic way a coupling member according to the present invention which is used to connect an accessory to a muzzle of a firearm.

FIG. 1 shows in a schematic way how a coupling member 1 according to the present invention is used to connect an accessory to a muzzle M of a firearm F, where the accessory is a silencer S. However, the accessory could also be a flash suppressor or muzzle brake, a grenade launcher, a blank adapter or the like.

Figure 2:
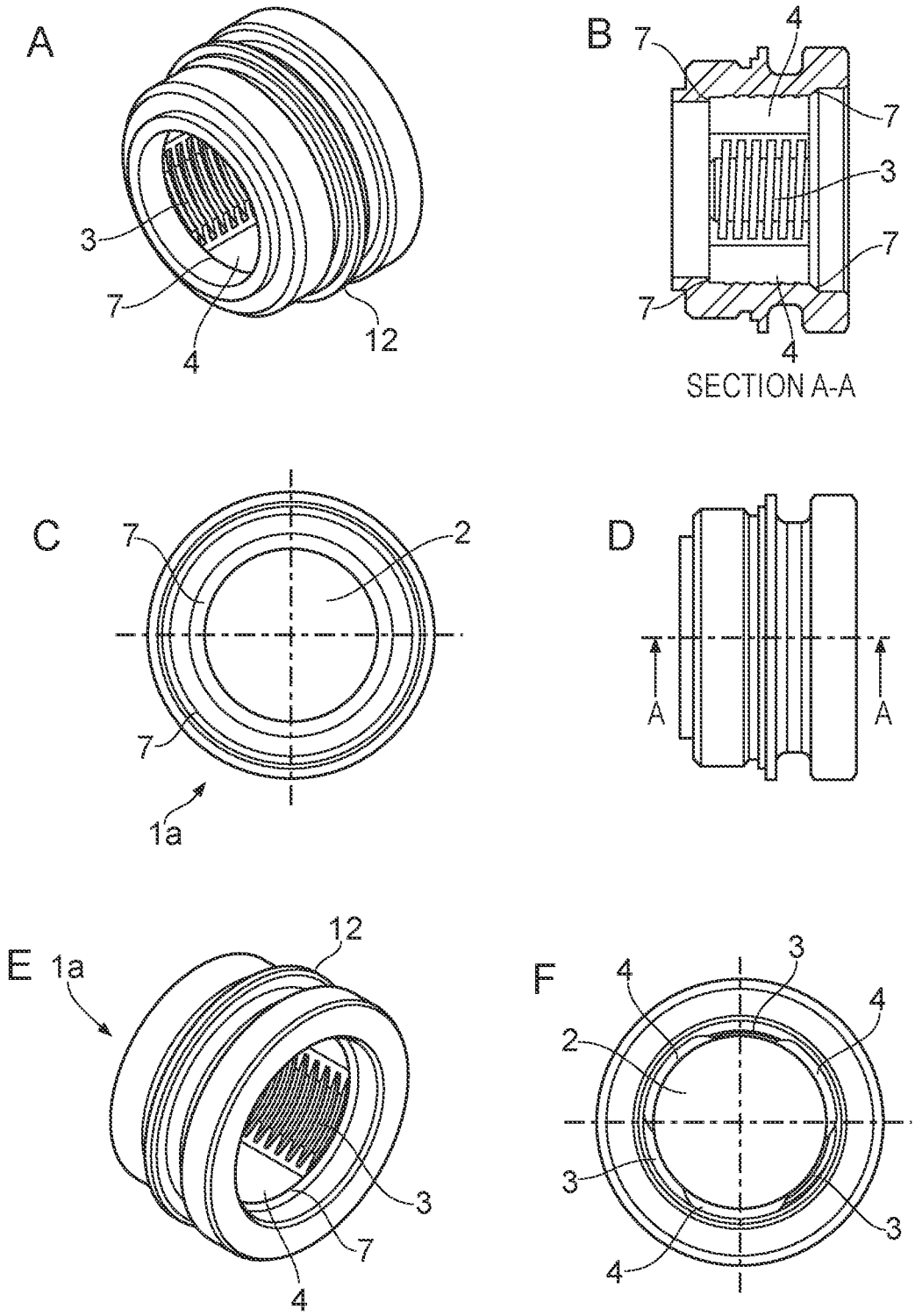
FIGS. 2A-F show a female member of the coupling member according to FIG. 1, from front, from behind, in a cross-section and in perspective views.

FIG. 2 shows a female member 1*a* of the coupling member 1 according to the present invention, where the female member 1*a* is provided with a throughgoing bore 2. A diameter of the throughgoing bore 2 will vary over the longitudinal length of the female member 1*a*, as will be described below.

Three threaded portions 3 and three unthreaded portions 4 are provided around a circumference of the throughgoing bore 2, where the threaded portions 3 and the unthreaded portions 4 are arranged in turns, i.e. a threaded portion 3 is followed by an unthreaded portion 4 and an unthreaded portion 4 is followed by a threaded portion 3. Each of the threaded portions 3 and each of the unthreaded portions 4 are displaced 60 degrees relative each other.

Furthermore, the female member 1*a* is provided with two abutment shoulders 7 extending around the whole circumference of the throughgoing bore 2, where the first abutment shoulder 7 is arranged in front of the threaded and unthreaded portions 3, 4 and the second abutment shoulder is arranged behind the threaded and unthreaded portions 3, 4. The first abutment shoulder defines a first diameter within the throughgoing bore 2, where the first diameter will extend to the second abutment shoulder 7, where the second abutment shoulder 7 will define a second diameter within the throughgoing bore 2. The area of the first diameter is formed to receive and accommodate a part of a male member 1*b* of the coupling member 1.

Figure 4:
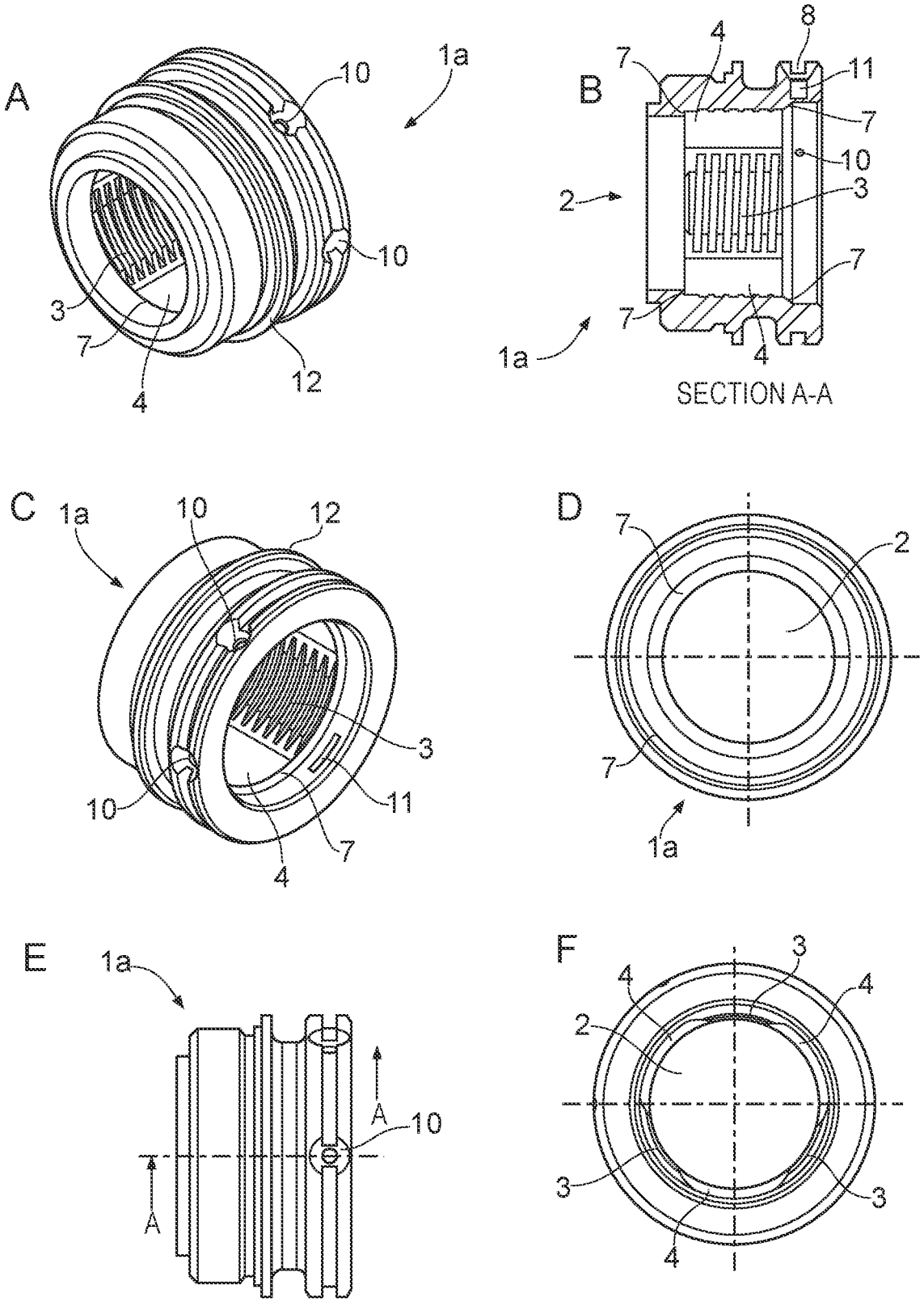
FIGS. 4A-F shows an alternative embodiment of a female member of a coupling member according to FIG. 2.

FIG. 4 shows an alternative embodiment of a female member 1*a* of the coupling member 1 according to the present invention, where the female member 1*a* is designed with a throughgoing bore 2, where a diameter of the throughgoing bore 2 will vary over the longitudinal length of the female member 1*a*.

Three threaded portions 3 and three unthreaded portions 4 are provided around a circumference of the throughgoing bore 2, where the threaded portions 3 and the unthreaded portions 4 are arranged in turns, i.e. a threaded portion 3 is followed by an unthreaded portion 4 and an unthreaded portion 4 is followed by a threaded portion 3. Each of the threaded portions 3 and each of the unthreaded portions 4 are displaced 60 degrees relative each other.

The female member 1*a* is furthermore provided with two abutment shoulders 7 extending around the whole circumference of the throughgoing bore 2, and where the first abutment shoulder 7 is arranged in front of the threaded and unthreaded portions 3, 4 and the second abutment shoulder is arranged behind the threaded and unthreaded portions 3, 4. The first abutment shoulder defines a first diameter within the throughgoing bore 2, where the first diameter will extend to the second abutment shoulder 7, where the second abutment shoulder 7 will define a second diameter within the throughgoing bore 2. The area of the first diameter is formed to receive and accommodate a part of a male member 1*b* of the coupling member 1.

In this embodiment, the female member 1*a* is also provided with a groove 8 around the outer circumference of the female member 1*a*, where the groove 8 is provided with two throughgoing holes 10 and a throughgoing recess 11, in which groove 8 a spring element 9 is to be arranged.

Figure 5:
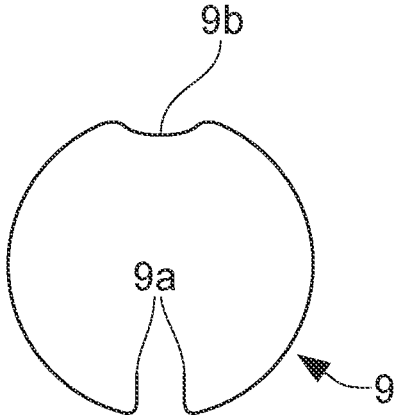
FIG. 5 shows a spring element that is used with the coupling member according to the present invention.

As can be seen from FIG. 5, the spring element 9 is provided with two end terminations 9*a* that are bent and a bead 9*b*. Through the form of the spring element 9 the spring element 9 can be arranged in the groove 8 provided in the female member 1*a*, where the bent end terminations 9*a* are used to hold the spring element 9 in place in the groove 8. When the spring element 9 is arranged in the groove 8, the bead 9*b* will be arranged in the throughgoing recess 11, and through its form and size, the bead 9*b* will extend or protrude into the throughgoing bore 2 of the female member 1*a*.

FIGS. 3A-D show a male member 1*b* of the coupling member 1 according to the present invention, where the male member 1*b* is provided with a throughgoing bore 13.

In a similar way as the female member 1*a*, the male member 1*b* is also provided with three threaded portions 5 and three unthreaded portions 6 around its circumference, where the threaded portions 5 and unthreaded portions 6 are arranged successively each other.

The male member 1*b* is also provided with a first abutment shoulder 8 and a second abutment shoulder 18.

Figure 3:
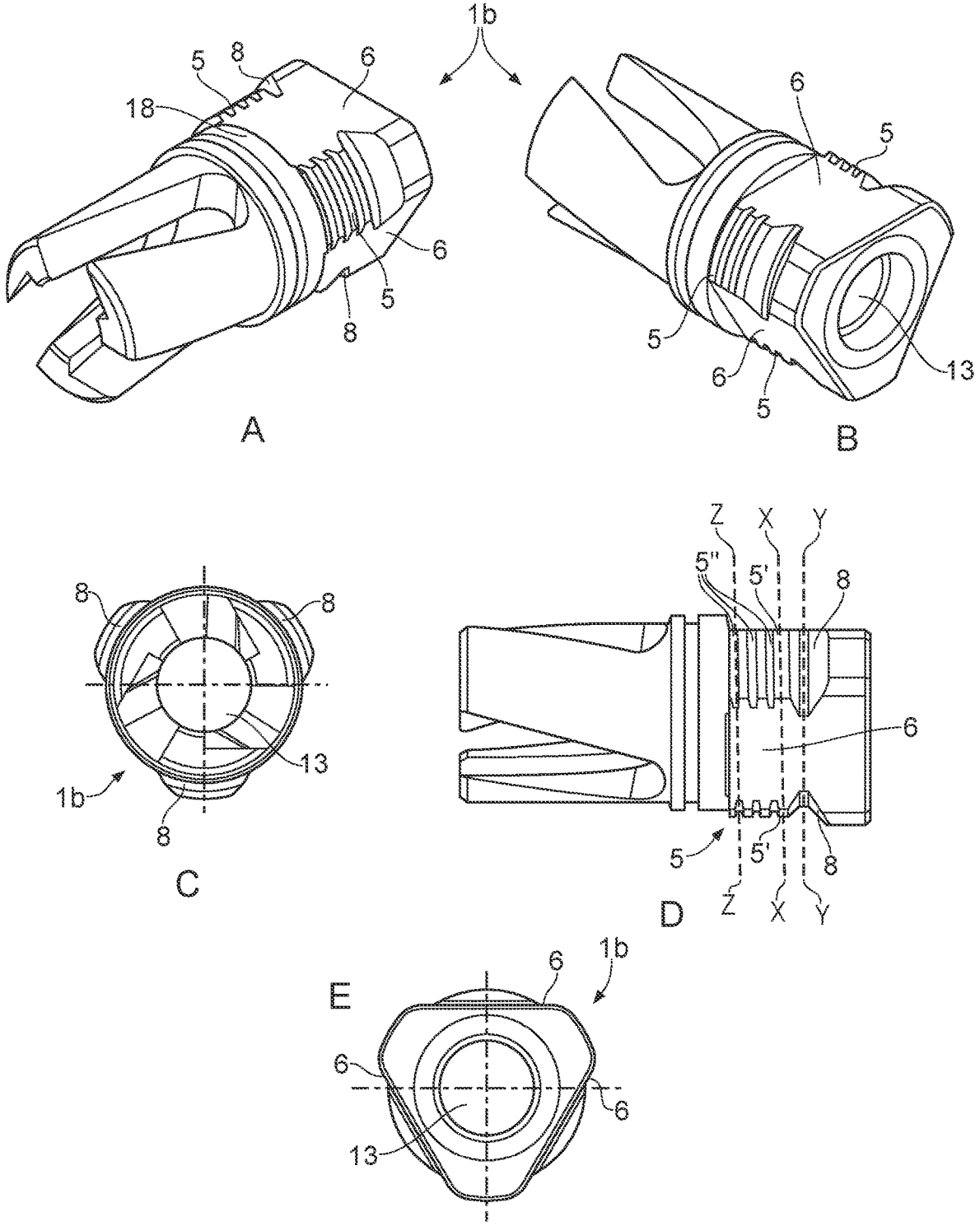
FIGS. 3A-E show a male member of the coupling member according to FIG. 1.

As can be seen from FIG. 3D, three dashed reference lines perpendicular to the longitudinal axis of the device, x, y, z, are arranged for illustration purposes to extend over a first threaded portion 5 (shown on left side of FIG. 3D) and to a subsequent threaded portion 5 (shown on right side of FIG. 3D).

The line y is drawn to extend between an area formed below the first abutment shoulder 8 of the male member 1*b*.

The line x is drawn to extend between a first thread 5' provided in the first threaded portion 5 (shown on left side of FIG. 3D) of the male member 1*b* and to a corresponding first thread 5' in the subsequent threaded portion 5 (shown on right side of FIG. 3D) of the male member 1*b*, where it can be seen that the first thread 5' in the first threaded portion 5 of the male member 1*b* and the corresponding thread 5' in the subsequent threaded portion will have a same entry or inlet relative a given horizontal plane (for instance the second abutment shoulder 18) and a same exit or outlet relative the horizontal plane (the second abutment shoulder 18).

The same will apply for each of the remaining threads 5' provided in the first threaded portion 5 of the male member 1*b* and the corresponding threads 5' of the remaining threaded portions 5 of the male member 1*b*.

The line y being arranged in a groove 5" between two adjacent threads 5' is drawn to extend between the first threaded portion 5 (shown on left side of FIG. 3D) of the male member 1*b* and to the subsequent threaded portion 5 (shown on right side of FIG. 3D) of the male member 1*b*, where it can be seen that the grooves of the two threaded portions 5 of the male member 1*b* will be situated along the straight line y.

The coupling member 1 according to the present invention may, for instance, be used to attach a silencer S to a muzzle M of a firearm F. The silencer S can then be attached to the firearm F either directly, or indirectly through use of a flash suppressor.

If the silencer S is attached directly to the firearm F, the muzzle M of the firearm F is designed to be the male part 1*b*, while the female part 1*a* is integrated in the silencer S, whereby the silencer S can be connected directly to the firearm F.

It should also be understood that the female member 1*a* could be provided as a separate adapter, where the adapter is designed to be connected to the silencer S. In this case the female member 1*a,* in the form of an adapter, must be provided with an external threaded area and the silencer S must be provided with a corresponding internal threaded area, such that the female member 1*a* and the silencer S could be connected to each other.

If the silencer S is attached indirectly to the firearm F through a flash suppressor, the flash suppressor is designed to be the male member 1*b,* while the female member 1*a* is either integrated in the silencer S, or the female member 1*a* is designed to be a separate adapter. If the female member 1*a* is a separate adapter, the adapter must be provided with an external threaded area and the silencer S must be provided with a corresponding internal threaded area, such that the female member 1*a* and the silencer S could be connected to each other.

Similarly, the flash suppressor must be provided with an internal threaded area and the muzzle M of the firearm F must be provided with a corresponding external threaded area, such that the flash suppressor could be connected to the muzzle M of the firearm F.

The coupling member 1 according to the present invention may also, for instance, be used to attach a flash suppressor to a muzzle M of a firearm F. The flash suppressor can then be attached to the firearm F either directly, or indirectly through use of a female member 1*a* in the form of a separate adapter.

If the flash suppressor is attached directly to the firearm F, the muzzle M of the firearm F is designed to be the male part 1*b,* while the female part 1*a* is integrated in the flash suppressor, whereby the flash suppressor can be connected directly to the firearm F.

If the flash suppressor is attached indirectly to the firearm F through a female member 1*a* in the form of an adapter, the adapter must be provided with an external threaded area and the flash suppressor must be provided with a corresponding internal threaded area, such that the female member 1*a* and the flash suppressor can be connected to each other.

When the female member 1*a* and the male member 1*b* of the coupling member 1 according to the present invention are to be attached to each other, the female member 1*a* must be connected to a firearm accessory if the female member 1*a* is not integrated in the firearm accessory. Thereafter the male member 1*b* is inserted into the female member 1*a* in such a way that the unthreaded portions 6 of the male member 1*b* are aligned with the threaded portions 3 of the female member 1*a,* whereafter the male member 1*b* is rotated anticlockwise in order to bring the threaded portions 5 of the male member 1*b* into contact with the threaded portions 3 of the female member 1*a,* thereby locking the female member 1*a* and the male member 1*b* of the coupling member 1. If the female member 1*a* is provided with the spring element 9, an additional force must be applied in order to overcome the effect of the bead 9*b*. When the female member 1*a* and the male member 1*b* of the coupling member 1 are to be detached from each other, the male member 1*b* is rotated clockwise, such that the threaded portions 5 of the male member 1*b* are brought out of contact with the threaded portions 3 of the female member 1*a*. When the male member 1*b* is rotated a certain distance, the unthreaded portions 6 of the male member 1*b* are aligned with the threaded portions 3 of the female member 1*a,* whereby the male member 1*b* can be removed from the female member 1*a*.

The present invention has now been explained with reference to embodiments, but a person skilled in the art will appreciate that changes and modifications will be able to be made to these embodiments which lie within the scope of the invention as defined in the following claims.

The invention claimed is:

1. A coupling member for quick and easy attachment and detachment of a firearm accessory to a muzzle of a firearm, the coupling member comprising a female member and a male member, wherein the female member is provided with a throughgoing bore, the female member further being provided with a number of successive threaded portions and unthreaded portions around a circumference of the throughgoing bore and wherein the male member around an outer circumference is provided with the same number of successive threaded portions and unthreaded portions as the female member, wherein each of the threaded portions and each of the unthreaded portions of the female member are equally displaced relative each other, where each of the threaded portions and each of the unthreaded portions of the male member are equally displaced relative each other, and wherein each thread in each threaded portion has a same entry/inlet relative to a horizontal plane and a same exit/outlet relative to the horizontal plane as each corresponding thread in the remaining threaded portions.

2. A coupling member according to claim 1, wherein the female member is provided with at least one abutment shoulder around the circumference of the throughgoing bore, the at least one abutment shoulder cooperating with at least one abutment shoulder provided around the outer circumference of the male member.

3. A coupling member according to claim 2, wherein said at least one abutment shoulder of the female and male member is arranged to be perpendicular on an axis extending through the throughgoing bore, or form an angle relative the axis.

4. A coupling member according to anyone of the preceding claims, wherein the female member is provided with a groove extending around the periphery of the female member, wherein the groove further is provided with two throughgoing holes and a throughgoing recess for reception of a spring element provided with end terminations and at least one bead.

5. A coupling member according to claim 4, wherein the female member is provided with an external threaded portion.

6. A coupling member according to claim 4, wherein the female member has a circular cross-section.

7. A coupling member according to claim 1, wherein the male member is provided with a throughgoing bore.

8. A coupling member according to claim 7, wherein the male member is provided with an internal threaded area.

9. A coupling member according to claim 7 or 8, wherein the male member over at least a part of its longitudinal length is provided with a substantially triangular form, where acute angles of the triangular form are rounded.

10. A coupling member according to claim 1, wherein the female member is a flame suppressor or an adapter/attachment element.

11. A coupling member according to claim 1, wherein the male member is a flame suppressor or a muzzle of a firearm.

* * * * *